US009570805B2

(12) United States Patent
Lai et al.

(10) Patent No.: US 9,570,805 B2
(45) Date of Patent: Feb. 14, 2017

(54) ANTENNA STRUCTURE AND WIRELESS COMMUNICATION DEVICE USING THE ANTENNA STRUCTURE

(71) Applicant: Chiun Mai Communication Systems, Inc., New Taipei (TW)

(72) Inventors: Chih-Hung Lai, New Taipei (TW); Yen-Hui Lin, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 150 days.

(21) Appl. No.: 14/543,266

(22) Filed: Nov. 17, 2014

(65) Prior Publication Data

US 2015/0155632 A1 Jun. 4, 2015

(30) Foreign Application Priority Data

Nov. 30, 2013 (CN) ..... 2013 1 0622289

(51) Int. Cl.

| | |
|---|---|
| ***H01Q 1/24*** | (2006.01) |
| ***H01Q 5/371*** | (2015.01) |
| ***H01Q 9/42*** | (2006.01) |
| ***H01Q 5/378*** | (2015.01) |

(52) U.S. Cl.

CPC ..... *H01Q 5/371* (2015.01); *H01Q 1/243* (2013.01); *H01Q 5/378* (2015.01); *H01Q 9/42* (2013.01)

(58) Field of Classification Search

CPC ..... H01Q 1/243; H01Q 1/38; H01Q 9/0421; H01Q 9/0407

USPC ..... 343/702, 700 MS, 853, 872

See application file for complete search history.

(56) References Cited

U.S. PATENT DOCUMENTS

| | | | | |
|---|---|---|---|---|
| 2004/0075611 A1* | 4/2004 | Kenoun | ..... | H01Q 1/243 343/702 |
| 2012/0081264 A1* | 4/2012 | Wang | ..... | H01Q 21/30 343/905 |

* cited by examiner

*Primary Examiner* — Dameon E Levi
*Assistant Examiner* — Collin Dawkins
(74) *Attorney, Agent, or Firm* — Zhigang Ma

(57) ABSTRACT

An antenna structure includes a main body, a first radiating body, and a second radiating body. The main body includes a feeding portion, a connecting portion, a first coupling portion, and a second coupling portion. The connecting portion is perpendicularly connected to the feeding portion. The first coupling portion and the second coupling portion are positioned at two opposite sides of the connecting portion. The first radiating body is configured to surround and resonate with the first coupling portion. The second radiating body is configured to surround and resonate with the second coupling portion.

18 Claims, 7 Drawing Sheets

| | X | Y |
|---|---|---|
| (1) | 0.704 | 38.828 |
| (2) | 0.746 | 25.900 |
| (3) | 0.824 | 53.367 |
| (4) | 0.960 | 89.216 |
| (5) | 1.710 | 92.333 |
| (6) | 2.170 | 93.886 |
| (7) | 2.300 | 94.212 |
| (8) | 2.400 | 93.463 |

| | X | Y |
|---|---|---|
| (1) | 0.704 | 35.890 |
| (2) | 0.746 | 22.204 |
| (3) | 0.824 | 44.606 |
| (4) | 0.960 | 66.782 |
| (5) | 1.710 | 69.151 |
| (6) | 2.170 | 82.608 |
| (7) | 2.300 | 85.148 |
| (8) | 2.400 | 86.009 |

ANTENNA STRUCTURE AND WIRELESS COMMUNICATION DEVICE USING THE ANTENNA STRUCTURE

FIELD

The subject matter herein generally relates to an antenna structure and a wireless communication device using the antenna structure.

BACKGROUND

Antennas are important elements of wireless communication devices, such as mobile phones or personal digital assistants. To communicate in multi-band communication systems, a bandwidth of an antenna in the wireless communication device needs to be wide enough to cover frequency bands of multiple bands. In addition, because of the miniaturization of the wireless communication device, space available for the antenna is reduced and limited.

BRIEF DESCRIPTION OF THE DRAWINGS

Implementations of the present technology will now be described, by way of example only, with reference to the attached figures.

DETAILED DESCRIPTION

Figure 1:
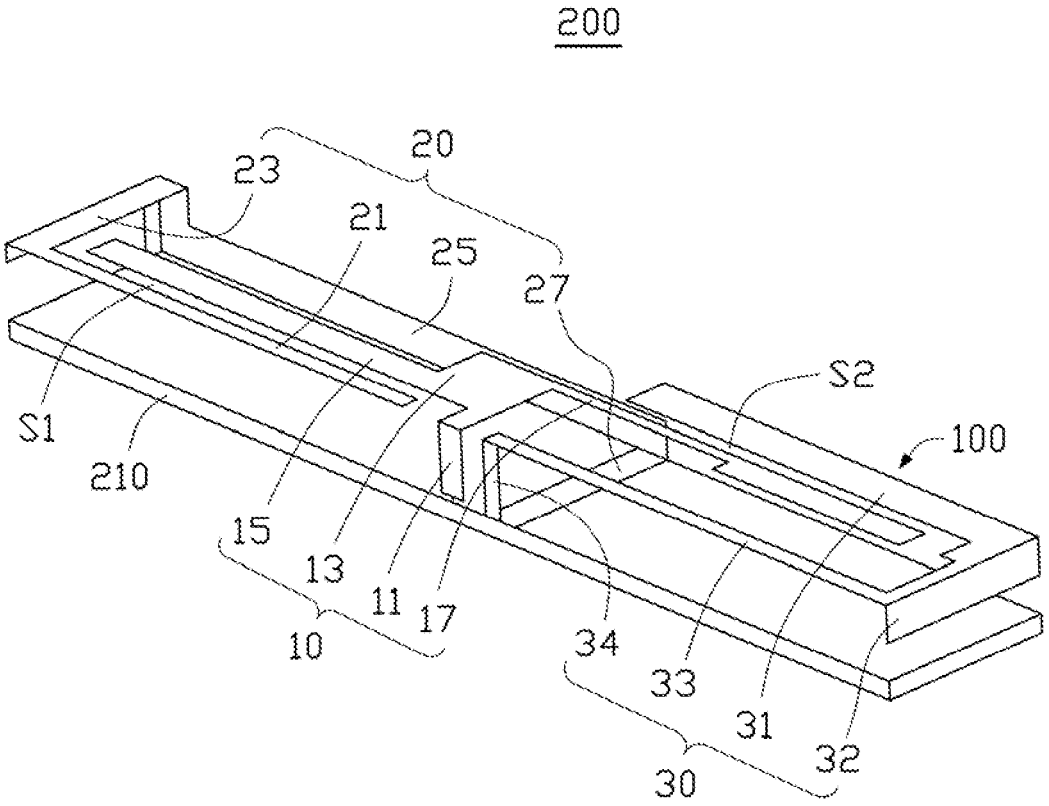
FIG. 1 is an isometric view of an embodiment of a wireless communication device employing an antenna structure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Several definitions that apply throughout this disclosure will now be presented.

The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising" when utilized, means "including, but not necessarily limited to"; it specifically indicates open-ended inclusion or membership in the so-described combination, group, series and the like.

FIG. 1 illustrates an embodiment of a wireless communication device 200 employing an antenna structure 100. The wireless communication device 200 can be a mobile phone or a personal digital assistant, for example. The wireless communication device 200 further includes a baseboard 210. The baseboard 210 can be a printed circuit board (PCB) of the wireless communication device 200. In this embodiment, the baseboard 210 is a keep-out-zone (not labeled) on the PCB of the wireless communication device 200. The purpose of the keep-out-zone is to delineate an area on the PCB in which other electronic components (such as a camera, a vibrator, a speaker, etc.) cannot be placed.

The antenna structure 100 is positioned above the baseboard 210 and includes a main body 10, a first radiating body 20, and a second radiating body 30. The main body 10 is a monopole antenna and includes a feeding portion 11, a connecting portion 13, a first coupling portion 15, and a second coupling portion 17.

The feeding portion 11 is a substantial strip and is positioned at a plane perpendicular to a plane that the baseboard 210 is positioned. The feeding portion 11 is electronically connected to a feeding point of the baseboard 210 for feeding current to the main body 10. The connecting portion 13 is perpendicularly connected to the feeding portion 11. In this embodiment, the connecting portion 13 is a substantially rectangular sheet and is positioned at a plane parallel to the plane that the baseboard 210 is positioned. The first coupling portion 15 is coplanar with the connecting portion 13. The first coupling portion 15 is a substantial strip and is positioned at a side of the connecting portion 13. The second coupling portion 17 is coplanar with the connecting portion 13. The second coupling portion 17 is substantially L-shaped and is positioned at another side of the connecting portion 13 opposite to the first coupling portion 15.

The first radiating body 20 surrounds the first coupling portion 15 of the main body 10 and is configured to resonate with the main body 10 to excite a first low-frequency resonating mode. The first radiating body 20 includes a first radiating portion 21, a second radiating portion 23, a third radiating portion 25, and a first grounding portion 27 connected in that order. The first radiating portion 21 is a substantial strip and is coplanar with the connecting portion 13. The first radiating portion 21 is spaced apart from and parallel to the first coupling portion 15. Thus, a first slot S1 is defined between the first radiating portion 21 and the first coupling portion 15. By changing a width of the first slot S1, the current from the first coupling portion 15 can be coupled to the first radiating body 20.

Figure 2:
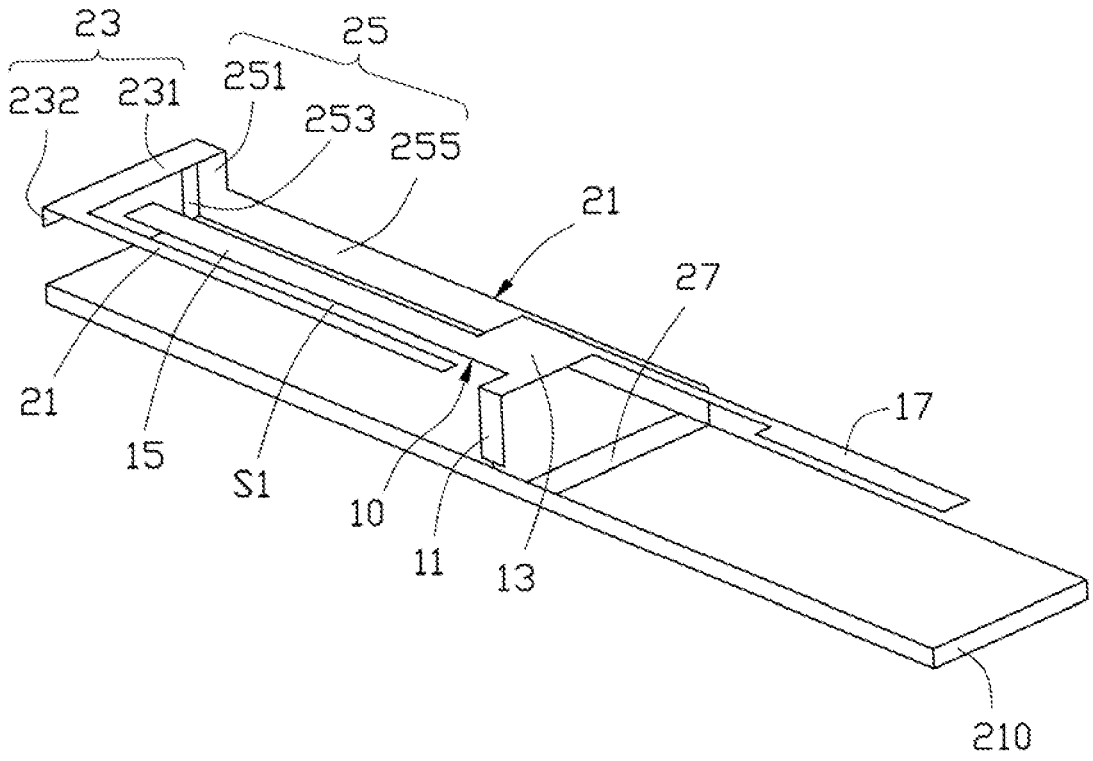
FIG. 2 is an isometric partial view of the antenna structure of FIG. 1, showing a main body and a first radiating body.

FIG. 2 illustrates that the second radiating portion 23 includes a first radiating section 231 and a second radiating section 232. The first radiating section 231 is coplanar with the first radiating portion 21. In this embodiment, the first radiating section 231 is a substantial strip and is perpendicularly connected to an end of the first radiating portion 21 away from the feeding portion 11. The second radiating section 232 is positioned at a plane perpendicular to planes that the baseboard 210 and the first radiating section 231 are positioned. In this embodiment, the second radiating section 232 is a substantial strip. The second radiating section 232 is perpendicularly connected to a side of the first radiating section 231 away from the first coupling portion 15 and extends towards the baseboard 210.

The third radiating portion 25 includes a third radiating section 251, a fourth radiating section 253, and a fifth radiating section 255. The third radiating section 251 is positioned at a plane parallel to the plane that the feeding portion 11 is positioned. The third radiating section 251 is perpendicularly connected to the first radiating section 231 and extends towards the baseboard 210. The fourth radiating section 253 is coplanar with the second radiating section 232. The fourth radiating section 253 is perpendicularly connected to a side of the third radiating section 251. The fifth radiating section 255 is coplanar with the third radiating section 251. In this embodiment, the fifth radiating section 255 is a substantial strip and is perpendicularly connected to another side of the third radiating section 251, thereby forming an L-shaped structure with the third radiating section 251. The first grounding portion 27 is positioned on the baseboard 210 and is perpendicularly connected to an end of the fifth radiating section 255 away from the third radiating section 251.

Figure 3:
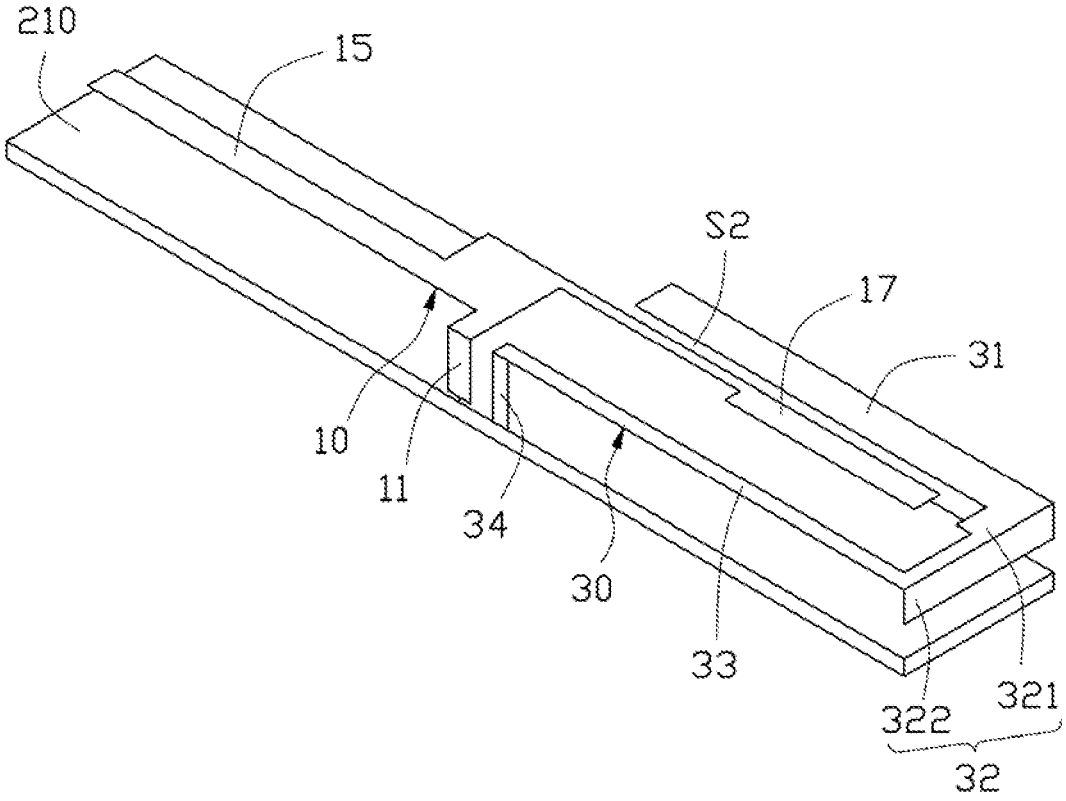
FIG. 3 is similar to FIG. 2, but showing the main body and a second radiating body.

FIG. 3 shows that the second radiating body 30 surrounds the second coupling portion 17 of the main body 10 and is configured to resonate with the main body 10 to excite a second low-frequency resonating mode. The second radiating body 30 includes a first extending portion 31, a second extending portion 32, a third extending portion 33, and a second grounding portion 34 connected in that order. The first extending portion 31 is a substantial strip and is coplanar with the connecting portion 13. The first extending portion 31 is spaced apart from and parallel to the second coupling portion 17. Thus, a second slot S2 is defined between the first extending portion 31 and the second coupling portion 17. By changing a width of the second slot S2, the current from the second coupling portion 17 can be coupled to the second radiating body 30.

The second extending portion 32 includes a first extending section 321 and a second extending section 322. The first extending section 321 is coplanar with the first extending portion 31. The first extending section 321 has a first end perpendicularly connected to an end of the first extending portion 31 away from the connecting portion 13 and a second end perpendicularly connected to the third extending portion 33. The first extending portion 31, the first extending section 321, and the third extending portion 33 cooperatively form a U-shaped structure for surrounding the second coupling portion 17. The second extending section 322 is positioned at a plane perpendicular to planes that the baseboard 210 and the first extending section 321 are positioned. In this embodiment, the second extending section 322 is a substantial strip. The second extending section 322 is perpendicularly connected to a side of the first extending section 321 away from the first extending portion 32 and extends towards the baseboard 210. The second grounding portion 34 is a substantial strip and is coplanar with the feeding portion 11. The second grounding portion 34 is perpendicularly connected between an end of the third extending portion 33 away from the first extending section 321 and the first grounding portion 27. In this embodiment, the second grounding portion 34 is spaced apart from and parallel to the feeding portion 11.

When a current feeds into the main body 10 via the feeding portion 11, a first current from the feeding portion 11 is coupled to the first radiating body 20 via the first coupling portion 15, the first slot S1, and the first coupling portion 21, and is further grounded via the first grounding portion 27. Thus, the main body 10 and the first radiating body 20 cooperatively form a first loop antenna to activate the first low-frequency resonating mode. Then, a second current from the feeding portion 11 is coupled to the second radiating body 30 via the second coupling portion 17, the second slot S2, and the second coupling portion 31, and is further grounded via the second grounding portion 34. Thus, the main body 10 and the second radiating body 30 cooperatively form a second loop antenna to activate the second low-frequency resonating mode.

Furthermore, the connecting portion 13, the first coupling portion 15, and the second coupling portion 17 cooperatively form a first current loop by resonating with the first radiating body 20 and the second radiating body 30 to activate a first high-frequency resonating mode. The connecting portion 13 can further form a second current loop by resonating with the first radiating body 20 to activate a second high-frequency resonating mode.

Figure 4:
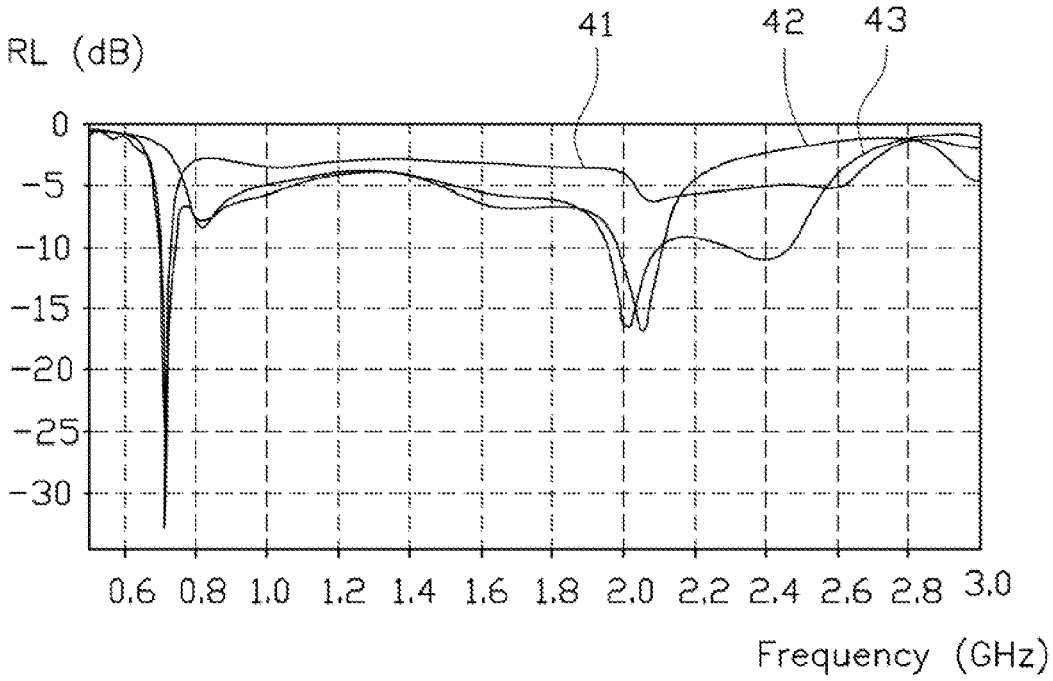
FIG. 4 is a diagram showing return loss (RL) measurements of the first radiating body, the second radiating body, and the antenna structure of FIG. 1.

FIG. 4 shows a return loss (RL) measurement of the antenna structure 100. In detail, curve 41, curve 42, curve 43 respectively illustrate a value of the RL of the first radiating body 20, a value of the RL of the second radiating body 30, and a value of the RL of the antenna structure 100, which all satisfy communication requirements.

Figure 5:
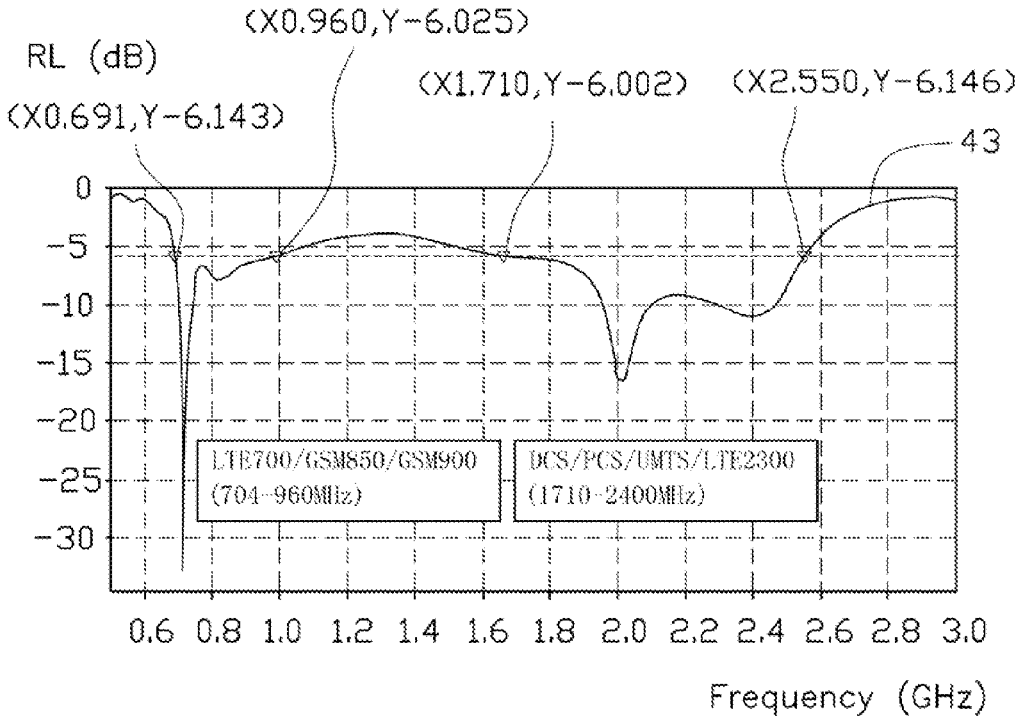
FIG. 5 is similar to FIG. 4, but only showing the RL measurements of the antenna structure of FIG. 1.

FIG. 5 illustrates that when a value of the RL of the antenna structure 100 is less than −6 dB, the antenna structure 100 can operates at frequency bands of from about 0.691 GHz to about 0.960 GHz, and from about 1.710 GHz to about 2.550 GHz. Therefore, the antenna structure 100 and the wireless communication device 200 employing the antenna structure 100 can be utilized in common wireless communication systems, such as LTE700/GSM850/GSM900 (704-960 MHz) and DCS/PCS/UMTS/LTE2300 (1710-2400 MHz), with exceptional communication quality.

Figure 6:
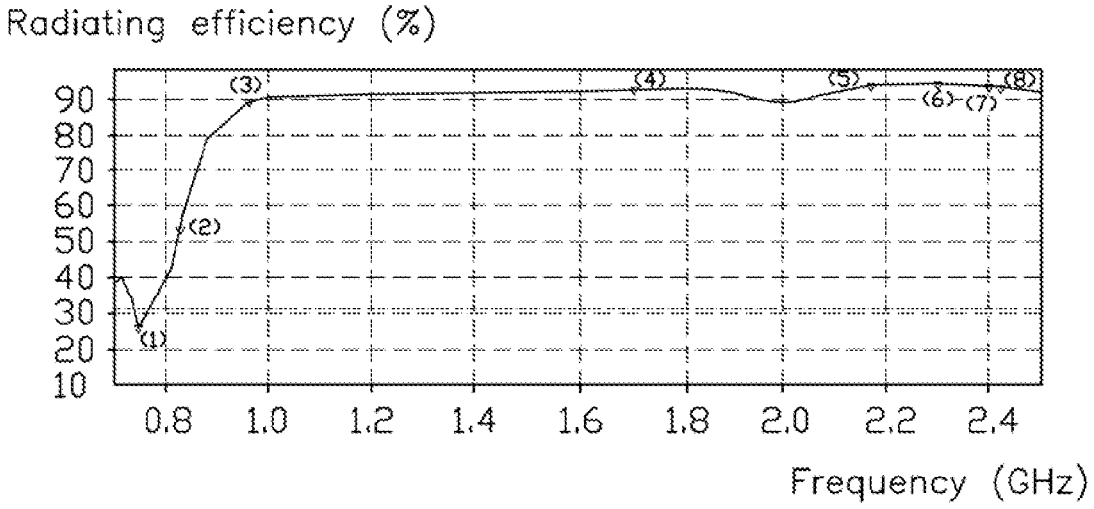
FIG. 6 is a radiating efficiency graph of the antenna structure of the wireless communication device of FIG. 1.
Figure 7:
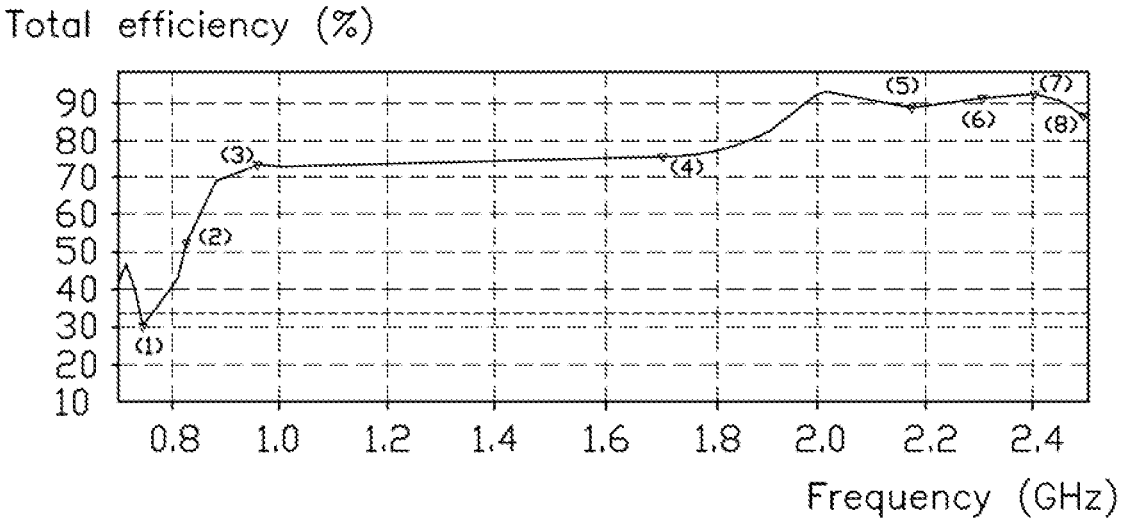
FIG. 7 is a total efficiency graph of the antenna structure of the wireless communication device of FIG. 1.

FIGS. 6 and 7 illustrate a radiating efficiency graph of the antenna structure 100 and a total efficiency graph of the antenna structure 100, respectively. The radiating efficiency and the total efficiency of the antenna structure 100 are both acceptable and satisfy radiation requirements.

The embodiments shown and described above are only examples. Many details are often found in the art. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims. It will therefore be appreciated that the embodiments described above may be modified within the scope of the claims.

What is claimed is:

1. An antenna structure comprising:

a main body comprising:

a feeding portion;

a connecting portion perpendicularly connected to the feeding portion;

a first coupling portion positioned at a first side of the connecting portion; and a second coupling portion positioned at a second side of the connecting portion;

a first radiating body configured to surround and resonate with the first coupling portion; and a second radiating body configured to surround and resonate with the second coupling portion;

wherein the first radiating body comprises a first radiating portion, a second radiating portion, and a third radiating portion connected in that order, the second radiating portion comprises a first radiating section and a second radiating section, the third radiating portion comprises a third radiating section, a fourth radiating section, and a fifth radiating section, the third radiating section is positioned at a plane parallel to the feeding portion and perpendicularly connected to the first radiating section; the fourth radiating section is coplanar with the second radiating section and perpendicularly connected to a side of the third radiating section; and the fifth radiating section is coplanar with the third radiating section and perpendicularly connected to another side of the third radiating section.

2. The antenna structure of claim 1, wherein the first radiating portion is spaced apart from and parallel to the first coupling portion, wherein a first slot is defined between the first radiating portion and the first coupling portion, and a current from the first coupling portion is coupled to the first radiating portion.

3. The antenna structure of claim 1, wherein the first radiating section is coplanar with the first radiating portion and perpendicularly connected to an end of the first radiating portion, the second radiating section is positioned at a plane perpendicular to a plane of the first radiating section, and the second radiating section is perpendicularly connected to a side of the first radiating section away from the first coupling portion.

4. The antenna structure of claim 1, wherein the first radiating body further comprises a first grounding portion, the first grounding portion is perpendicularly connected to an end of the fifth radiating section and configured to ground the first radiating body.

5. The antenna structure of claim 4, wherein the second radiating body comprises a first extending portion, the first extending portion is spaced apart from and parallel to the second coupling portion, wherein a second slot is defined between the first extending portion and the second coupling portion, and a current from the second coupling portion is coupled to the first extending portion.

6. The antenna structure of claim 5, wherein the second radiating body further comprises a second extending portion and a third extending portion, the second extending portion comprises a first extending section, the first extending section has a first end perpendicularly connected to an end of the first extending portion and a second end perpendicularly connected to the third extending portion, the first extending portion, the first extending section, and the third extending portion cooperatively form a U-shaped structure for surrounding the second coupling portion.

7. The antenna structure of claim 6, wherein the second extending portion further comprises a second extending section, the second extending section is positioned at a plane perpendicular to a plane of the first extending section, and the second extending section is perpendicularly connected to a side of the first extending section away from the first extending portion.

8. The antenna structure of claim 6, wherein the second radiating body further comprises a second grounding portion, the second grounding portion is perpendicularly connected between an end of the third extending portion away from the first extending section and the first grounding portion.

9. An antenna structure comprising:

a main body comprising:

a feeding portion;

a connecting portion perpendicularly connected to the feeding portion;

a first coupling portion positioned at a side of the connecting portion; and a second coupling portion positioned at another side of the connecting portion opposite to the first coupling portion;

a first radiating body surrounding the first coupling portion and comprising a first radiating portion, a second radiating portion, and a third radiating portion connected in that order, wherein the second radiating portion comprises a first radiating section and a second radiating section, the third radiating portion comprises a third radiating section, a fourth radiating section, and a fifth radiating section, the third radiating section is positioned at a plane parallel to the feeding portion and perpendicularly connected to the first radiating section; the fourth radiating section is coplanar with the second radiating section and perpendicularly connected to a side of the third radiating section; and the fifth radiating section is coplanar with the third radiating section and perpendicularly connected to another side of the third radiating section; and a second radiating body surrounding the second coupling portion;

wherein a first current from the feeding portion is coupled to the first radiating body through the first coupling portion to activate a first low-frequency resonating mode, and a second current from the feeding portion is coupled to the second radiating body through the second coupling portion to activate a second low-frequency resonating mode.

10. The antenna structure of claim 9, wherein the first radiating portion is spaced apart from and parallel to the first coupling portion, wherein a first slot is defined between the first radiating portion and the first coupling portion, and the first current from the first coupling portion is coupled to the first radiating portion.

11. The antenna structure of claim 9, wherein the first radiating section is coplanar with the first radiating portion and perpendicularly connected to an end of the first radiating portion, the second radiating section is positioned at a plane perpendicular to a plane of the first radiating section, and the second radiating portion is perpendicularly connected to a side of the first radiating section away from the first coupling portion.

12. The antenna structure of claim 9, wherein the first radiating body further comprises a first grounding portion, the first grounding portion is perpendicularly connected to an end of the fifth radiating section and configured to ground the first radiating body.

13. The antenna structure of claim 12, wherein the second radiating body comprises a first extending portion, the first extending portion is spaced apart from and parallel to the second coupling portion, wherein a second slot is defined between the first extending portion and the second coupling portion, and the second current from the second coupling portion is coupled to the first extending portion.

14. The antenna structure of claim 13, wherein the second radiating body further comprises a second extending portion and a third extending portion, the second extending portion comprises a first extending section, the first extending section has a first end perpendicularly connected to an end of the first extending portion and a second end perpendicularly connected to the third extending portion, the first extending portion, the first extending section, and the third extending portion cooperatively form a U-shaped structure for surrounding the second coupling portion.

15. The antenna structure of claim 14, wherein the second extending portion further comprises a second extending section, the second extending section is positioned at a plane perpendicular to a plane of the first extending section, and the second extending section is perpendicularly connected to a side of the first extending section away from the first extending portion.

16. The antenna structure of claim 14, wherein the second radiating body further comprises a second grounding portion, the second grounding portion is perpendicularly connected between an end of the third extending portion away from the first extending section and the first grounding portion.

17. A wireless communication device comprising:

a baseboard; and an antenna structure positioned above the baseboard, the antenna structure comprising:

a main body comprising:

a feeding portion;

a connecting portion perpendicularly connected to the feeding portion;

a first coupling portion positioned at a first side of the connecting portion; and a second coupling portion positioned at a second side of the connecting portion;

a first radiating body configured to surround and resonate with the first coupling portion; and a second radiating body configured to surround and resonate with the second coupling portion;

wherein the first radiating body comprises a first radiating portion, a second radiating portion, and a third radiating portion connected in that order, the second radiating portion comprises a first radiating section and a second radiating section, the third radiating portion comprises a third radiating section, a fourth radiating section, and a fifth radiating section, the third radiating section is positioned at a plane parallel to the feeding portion and perpendicularly connected to the first radiating section; the fourth radiating section is coplanar with the second radiating section and perpendicularly connected to a side of the third radiating section; and the fifth radiating section is coplanar with the third radiating section and perpendicularly connected to another side of the third radiating section.

18. The wireless communication device of claim 17, wherein the baseboard is a keep-out-zone on a printed circuit board of the wireless communication device.

* * * * *